United States Patent [19]

Moser

[11] 4,319,587

[45] Mar. 16, 1982

[54] SMOKING ARTICLE

[75] Inventor: Irving S. Moser, 1625 Winton Ave., Havertown, Pa. 19083

[73] Assignee: Irving S. Moser, Havertown, Pa.

[21] Appl. No.: 700,579

[22] Filed: Jun. 28, 1976

Related U.S. Application Data

[63] Continuation-in-part of Ser. No. 584,921, Jun. 9, 1975, abandoned.

[51] Int. Cl.[3] ..... A24D 1/02; A24D 1/16; A24F 1/00; A24F 47/00

[52] U.S. Cl. ..... 131/270; 131/329; 131/330; 131/349; 131/360

[58] Field of Search ..... 131/4 R, 4 A, 4 B, 8 R, 131/8 A, 9, 10, 263, 45 A; 40/321, 1.34; 35/31 E; 10/334

[56] References Cited

FOREIGN PATENT DOCUMENTS 1187287 11/1957 France ..... 131/8 A UX

*Primary Examiner*—V. Millin

*Attorney, Agent, or Firm*—Robert B. Frailey

[57] ABSTRACT

An improved smoking article, such as a cigarette or cigar, having means for controlling quickly, accurately and selectively the extent of consumption of the smoking article, to assist a habitual smoker in voluntarily curtailing or terminating his smoking habit. The control means comprises a generally tubular outer wrapping on the article on which are marked, printed, or otherwise imposed, spaced indicia in the nature of a scale, extending longitudinally of the article, and an annular control indicator mounted telescopically on the article and slidable axially relative thereto. The indicia may be accompanied by contrasting designs or markings, to provide quick, accurate and carefully selected voluntary control by the smoker of the extent of consumption of the smoking article. The annular control indicator contrasts visually relative to the smoking article.

4 Claims, 9 Drawing Figures

SMOKING ARTICLE

CROSS REFERENCE TO OTHER APPLICATION

This application is a continuation-in-part of my pending patent application Ser. No. 584,921, filed June 9, 1975, entitled "Smoking Article" now abandoned.

SUMMARY OF THE INVENTION

The primary object of this invention is to provide an improved smoking article, such as a cigarette or a cigar, which is provided with indicia, in the nature of an external scale or graduations, which enables the smoker to determine quickly, accurately, and voluntarily the extent to which he may wish to consume the smoking article.

A further object of the invention is to provide a smoking article, such as a cigarette or a cigar, having an outer wrapping bearing spaced smoking control indicia extending from the end of the article to be lit in the direction of the end of the article which is inserted into the smoker's mouth, and having an annular smoking control indicator mounted telescopically on the article with capacity for slidable displacement axially thereof.

A further object is to provide means for controlling quickly, accurately and selectively the extent of consumption of a cylindrical smoking article, to assist a habitual smoker in voluntarily curtailing or terminating his smoking habit, said means comprising a plurality of spaced external markings on the smoking article extending substantially the full length of the article, each marking being at least partially of arcuate formation, and a control indicator comprising a smoking control alert band selectively displaceable longitudinally of the smoking article relative to the markings, said smoking control alert band contrasting visually relative to the smoking article.

A further object is to provide voluntary smoking control means for a cylindrical smoking article comprising an annular control indicator mounted telescopically on the article with capacity for axial displacement relative thereto, scale-like spaced indicia disposed externally of the article, to permit selected longitudinal location of the annular indicator relative to the article, said control indicator being composed of a substance which reacts with the glowing end of a lighted smoking article to provide a warning when the article has been smoked to the vicinity of the location of the indicator.

Other objects and advantages of this invention will be readily apparent from the following specification and the accompanying drawing.

DETAILED DESCRIPTION OF THE INVENTION

Figure 1:
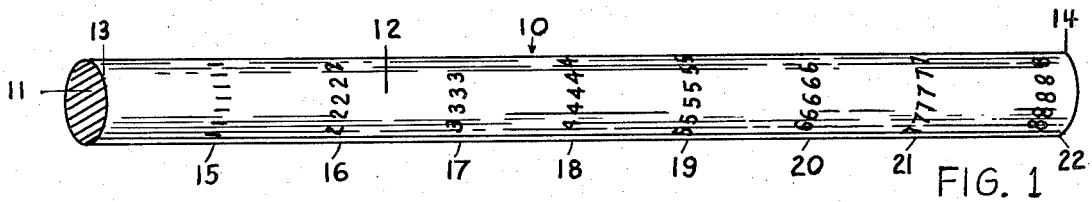
FIG. 1 is a perspective view of a cigarette incorporating a preferred embodiment of this invention.
Figure 7:
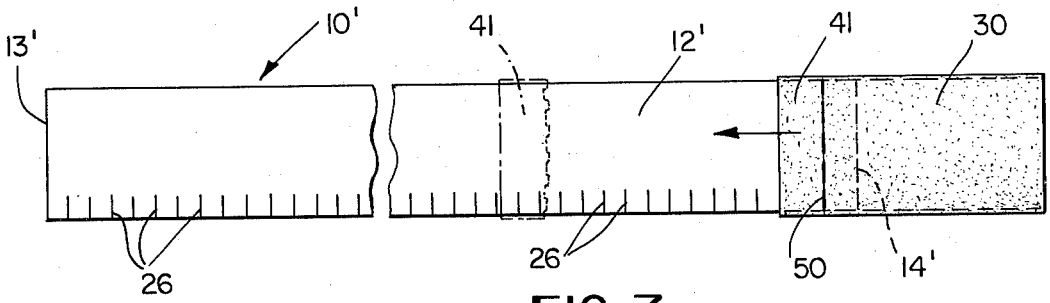
FIG. 7 is a longitudinal view illustrating a modification of the cigarette illustrated in FIG. 6.

In FIG. 1 there is shown a preferred cigarette 10 of this invention composed of a cylindrical column of tobacco 11 enclosed within an external paper or paper-like wrapper 12. The cigarette 10 may be of any desired length, such as "regular" size or "king" size. It is provided with an end 13 to be lit and an opposite end 14, which is inserted into the mouth of the smoker when the cigarette is consumed. If desired, the mouth end of the cigarette may be provided with a conventional tip or filter 30 (FIG. 7).

In the embodiment of this invention illustrated in FIG. 1, the external wrapper 12 of the cigarette is provided with external markings or indicia 15, 16, 17, 18, 19, 20, 21 and 22, which are disposed at spaced intervals along the full length of the cigarette 10. Preferably, the several indicia are spaced at uniform intervals along the cigarette, and extend annularly completely around the cigarette wrapper at each of their respective locations. The several markings or indicia 15, 16, etc., may be spaced one centimeter apart from each other, although it will be readily understood that other units of measurement may be employed.

It is preferred that the several markings or indicia 15, 16, etc., be scale-like, or in the nature of graduations, to facilitate careful, conscious control of the extent to which the cigarette may be consumed by the smoker. To aid in this objective, the individual markings or indicia 15, 16, etc., are each composed of an annulus of minerals, the numerals being identical for each separate annulus, and progressing upward in the Arabic scale of numbers as the spaced markings 15, 16, etc., extend from the end 13 of the cigarette in the direction of the end 14.

Thus, with the arrangement illustrated in FIG. 1, and with the individual indicia 15, 16, etc., spaced one centimeter apart, the smoker may readily ascertain visually when he has consumed 1, or 2, or 3, etc., centimeters of the cigarette. Accordingly, a very careful, precise, visual control is provided to enable the smoker to determine selectively and precisely the extent to which he or she has consumed, or may wish to consume, the cigarette.

Figure 2:
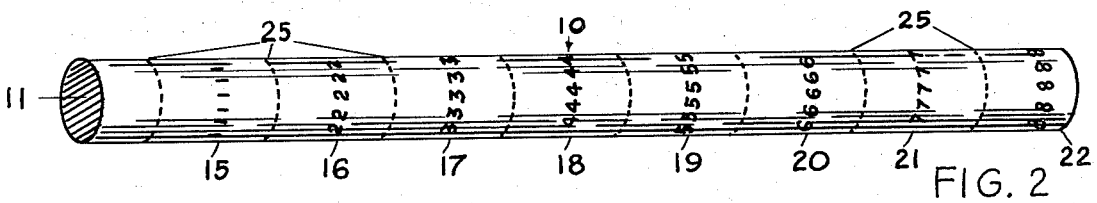
FIGS. 2 to 5 inclusive are perspective views of cigarettes, each of which incorporates a variation of this invention.

In the modification shown in FIG. 2, broken line annular markings or sub-indicia 25 are provided intermediate of the markings 15, 16, etc. In the embodiment where the indicia 15, 16, etc., are uniformly spaced at intervals of one centimeter, the additional sub-indicia 25 also may be spaced one centimeter from each other, thereby providing a series of successive, visual smoking control markings spaced at intervals of one-half centimeter along the longitudinal axis of the cigarette.

Figure 3:
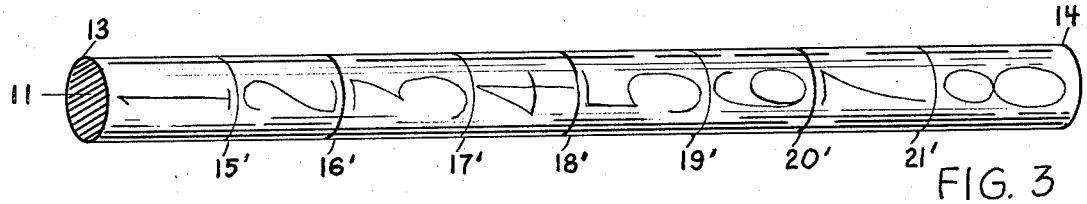

In FIG. 3, the several axially extending markings comprise annular bands 15', 16', 17', 18', 19', 20' and 21'. The spaces between the intervals or indicia 15', 16', etc., may be progressively numbered or otherwise marked, for example, with Arabic numerals, as shown. In FIG. 3 embodiment, the several successive markings 15', 16', 17', 18', etc., are disposed at non-uniform axial intervals along the cigarette. Thus, in the FIG. 3 embodiment, the axial lengths of the spaces bearing the numerals 2, 4 and 6, for example, are shorter than the axial lengths of the spaces bearing the numerals 1, 3, 5, 7 and 8.

Figure 4:
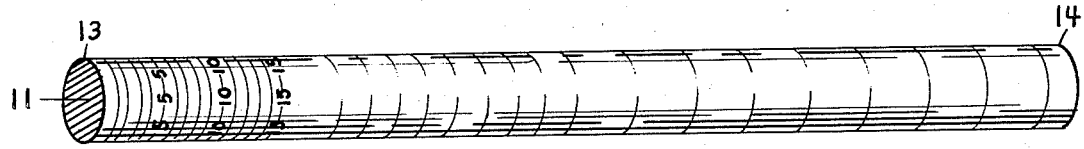

FIG. 4 shows yet a further modification embodying spaced smoking control indicia and sub-indicia in the form of separate series of annular bands, the spacing between the individual, successive bands or markings of each succeeding series increasing in axial width. For example, the first series of axially spaced, smoking control indicia may be spaced one millimeter apart, and every fifth millimeter markings may be designated in a scale-like manner, as shown in FIG. 4, to indicate successive distances of 5 millimeters, 10 millimeters, 15 millimeters, etc., from the end 13 of the cigarette. The succeeding series of smoking control markings, in graduated or scale-like fashion, may be provided with progressively greater axial spacing as desired, increasing, for example, to intervals on the order of one-half centimeter between successive markings or indicia in the area adjacent the end 14 of the cigarette.

Figure 5:
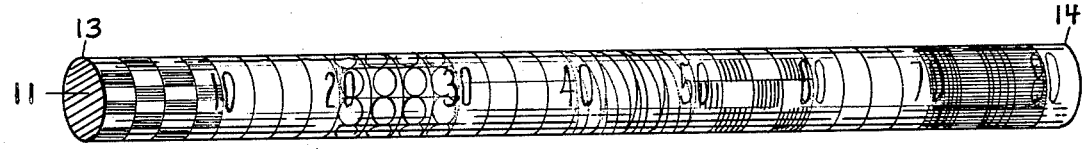

The embodiment of the invention illustrated in FIG. 5 illustrates how a variety of annular spaces of contrasting color, shading or design may be incorporated into the axial spacing between succeeding smoking control indicia of the cigarette. Each successive marking may be numbered, in scale-like fashion, for example, by numerals 10, 20, 30, etc., as illustrated, if desired, to facilitate selective voluntary control over the extent to which the cigarette is consumed.

Figure 6:
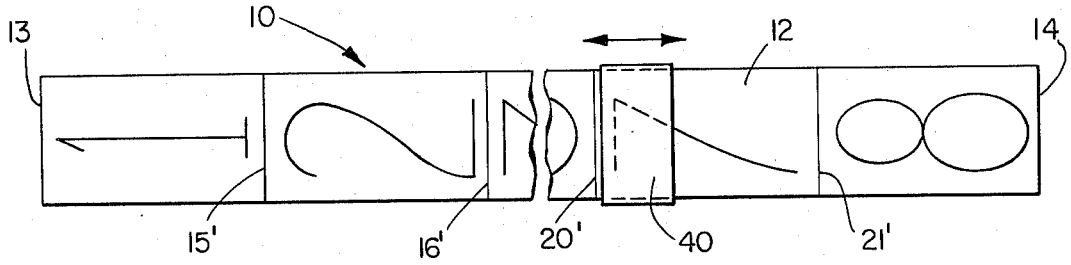
FIG. 6 is a longitudinal view of a preferred modification of a cigarette incorporating this invention, provided with an annular control indicator mounted telescopically on the cigarette.

In FIG. 6 there is shown a preferred modification of this invention adapted to a cigarette 10 of the type, for example, illustrated in FIG. 3. Mounted telescopically on the cigarette 10, externally of its wrapper 12, is an annular smoking control indicator 40. The latter serves as a smoking control alert band. It is designed to fit snugly on the outer tubular surface of the cigarette 10, with capacity for slidable axial displacement relative thereto, as indicated by the double headed arrow in FIG. 6. The annular control indicator 40 may be slid longitudinally along the outer tubular surface of the cigarette, and located selectively at any desired position between its ends 13 and 14. This enables a smoker to select quickly, accurately and voluntarily the extent to which he may wish to consume the cigarette. The several axially spaced indicia or markings 15', 16', etc., facilitate the displacement of the band 40 to a selected location on the cigarette.

The slidable smoking control indicator band 40 illustrated in FIG. 6 may, of course, be employed with any of the cigarettes illustrated in FIGS. 1 to 5 inclusive, whereby a smoker may quickly and selectively determine the extent to which he may wish to consume the cigarette.

In the preferred modification illustrated in FIG. 6, the slidable smoking control alert band 40 is shown as being transparent. It is preferred that the band 40 contrast visually relative to the outer tubular surface 12 of the cigarette 10, in order to facilitate use of the band as a smoking control indicator. However, the band 40 may be opaque, or it may be luminescent, permitting its ready visibility in the dark, or it may be in the form of an annular label. If desired, the smoking control indicator or alert band 40 may be formed of a material or substance which reacts in some selected manner with the glowing end of a lighted cigarette, to provide an automatic warning signal when the cigarette has been smoked to the vicinity of the indicator 40. For example, the band 40 may be composed of a fire-retardant or inflammability-reducing material of the type disclosed in S. E. Seaman U.S. Pat. Nos. 1,996,002 or 2,013,508. Alternatively, if desired, the band 40 may be composed of a material which, upon contact with the fire of the glowing end of a lighted cigarette, reacts to produce a smoke signal or a change in the rate of burning, to warn the smoker when he has consumed the cigarette to the selected degree desired. To use of such smoker warning-type materials is known, as indicated by the disclosures of H. M. Legler U.S. Pat. Nos. 2,746,890 and H. C. Fay et al 2,836,183. Generally, it is preferred that the band 40 be non-fire extinguishing.

In FIG. 7 there is illustrated a modification of the invention comprising a cigarette 10' having an outer paper wrapping 12', a front end 13' and a filter 30 provided at its rear end 14'. Disposed on the outer wrapping 12' are smoking control indicia comprising uniformly spaced arcuate markings 26 extending from the front end 13' of the cigarette rearwardly to the vicinity of the filter 30. In the cigarette of FIG. 7, the annular control indicator 41 is formed of the same material as the outer wrapping of the filter 30. The indicator or alert band 41 may be secured detachably, by means of a circle of perforations 50, to the inner end of the filter 30. By this arrangement, the band 41 may be readily separated from the filter 30 and moved axially along the outer wrapping 12' of the cigarette 10', as shown in phantom, to any selected position relative to the arcuate markings 26.

In the embodiment of FIG. 7, the smoking control alert band 41 may be detachably secured to the filter 30 in any selected manner. For example, the separation line 50 between the band 41 and the filter 30 may be a circular scored line, rather than a circle of perforations. Alternatively, the band 41 may be mounted telescopically on the outer surface of the filter 30, in the same manner as the band 40 is disposed on the outer wrapping 12 of the cigarette 10 of FIG. 6. In that event, the band 41 may be detachably secured to the external surface of the filter 30 by any suitable readily breakable seal, adhesive or the like.

Figure 8:
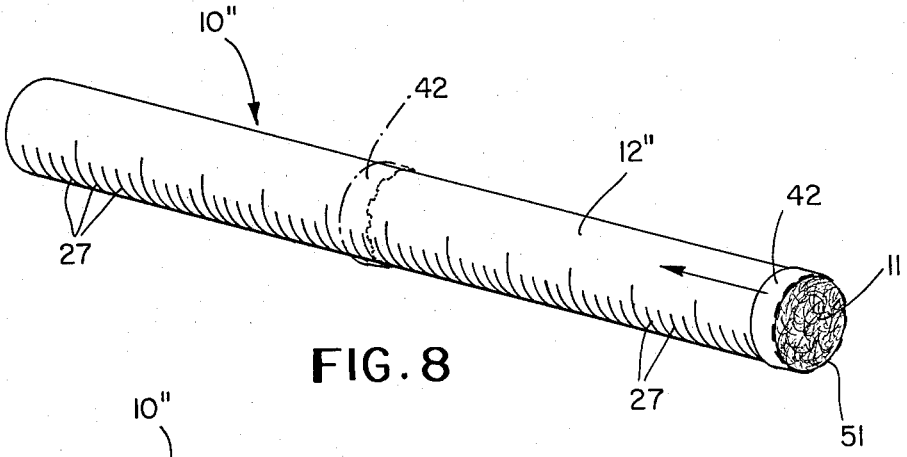
FIG. 8 is a perspective view of another modification of the cigarette illustrated in FIG. 6.

In the modification illustrated in FIG. 8, the outer surface of the cigarette 10'' is provided with longitudinally spaced indicia in the form of arcuate markings 27 of variable angular length. In this modification, the annular control indicator 42 is formed as a tubular extension of the outer wrapper 12'' of the cigarette, and preferably is folded back to overlay the wrapper 12'' adjacent one end of the column of tobacco 11. The control band 42 is secured to the end of the wrapper 12'' by a circle of perforations or by a score line 51, which may readily be broken or severed, to permit longitudinal displacement of the band 42 as indicated in phantom in FIG. 8. Since the band 42 is an extension of the combustible wrapper 12'', it necessarily is non-fire extinguishing.

Figure 9:
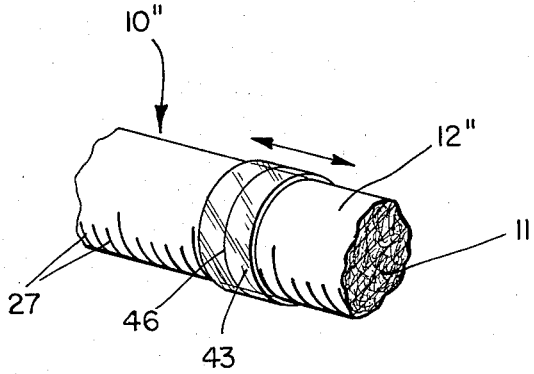
FIG. 9 is a fragmentary view in perspective illustrating yet a further modification of the cigarette illustrated in FIG. 6.

FIG. 9 shows yet another modification of this invention. In this modification, the slidable control indicator or band is in the form of a vernier 43, provided with at least one scale marking 46. If desired, the vernier 43 may be transparent, and may be provided with one or more markings 46 which may be opaque or luminescent, or both. FIG. 9 shows use of the indicator band 43 applied to the cigarette 10'' of FIG. 8, in place of the indicator band 42. It is to be understood, however, that the vernier-type indicator band 43 may be utilized with any of the cigarettes illustrated in FIGS. 1 to 7 inclusive hereof.

Thus, the embodiments of the invention illustrated in FIGS. 6 to 9 inclusive consist of two cooperating parts, one comprising a relatively stationary, indicia bearing, smoking article such as a cigarette, and the other comprising a relatively movable element in the form of an annular indicator or band, selectively displaceable axially relative to the smoking article.

For a variety of reasons, a habitual smoker may wish to abate or terminate his smoking habit. This invention provides both inspiration and means whereby a habitual smoker may quickly, accurately and selectively control his smoking so that, of his volition, he may curtail the habit, or phase it out completely, through his own self-discipline. If a smoker, utilizing one of the embodiments of the invention illustrated in FIGS. 6–9, does not desire to control his smoking, he may remove the slidable band 40, 41, 42 and 43 and discard them.

Surely, there are millions of smokers on this planet who have been waiting for an invention like this, to help them curtail or solve their smoking habit. As has been well said, "there is nothing more powerful than an idea whose time has come." That observation is particularly applicable to the utility of the present invention, which provides a practical and easily adaptable solution to the universal problem of habitual smoking, giving hope to millions of a controllable and realistic solution to that problem.

In the claims appended hereto, the term "at least partially of arcuate formation", as applied to the indicia or markings on the smoking article, is intended to indicate that such indicia or markings may be either of annular or arcuate formation and, if of arcuate formation, may be of variable angular lengths.

Although preferred embodiments of this invention have been shown and described for the purpose of illustration, as required by Title 35 U.S.C. 112, it is to be understood that various changes and modifications may be made in the embodiments of the invention illustrated, without departing from the spirit, novelty and utility of this invention, or from the scope thereof as set forth in the appended claims.

I claim:

1. For use with a generally cylindrical smoking article having an end to be lit and an opposite end to be inserted into the mouth when the article is smoked, positive control means for selecting the extent of consumption of said smoking article, to assist a smoker in curtailing or terminating his smoking habit, said means comprising:

(a) control indicia disposed on the smoking article and extending from the end of the article to be lit toward the opposite end of the article, said control indicia comprising a plurality of spaced external markings extending axially along the article, and (b) an annular control indicator mounted telescopically on the smoking article and being secured detachably to the smoking article adjacent one end thereof, said annular control indicator being detachable from the smoking article with capacity for being slidable axially relative thereto, said control indicator, when detached, comprising a smoking control alert band selectively displaceable on the article relative to the markings, (c) said control indicia and said annular control indicator cooperating to provide a smoker with heightened awareness of his smoking habit, whereby the smoker is enabled to affirmatively, selectively and voluntarily control said habit.

2. The smoking article of claim 1, comprising a cigarette having a tubular outer wrapping and a filter secured to one end thereof, the markings being disposed on the wrapping, wherein the smoking control alert band is secured detachably to the filter, and is adapted to be separated from the filter and moved axially of the cigarette for location relative to any selected marking on the wrapping of the cigarette.

3. For use with a generally cylindrical smoking article having an end to be lit and an opposite end to be inserted into the mouth when the article is smoked, positive control means for selecting the extent of consumption of said smoking article, to assist a smoker in curtailing or terminating his smoking habit, said means comprising:

(a) control indicia disposed on the smoking article and extending from the end of the article to be lit toward the opposite end of the article, said control indicia comprising a plurality of spaced external markings extending axially along the article, and (b) an annular control indicator mounted telescopically on the smoking article and slidable axially relative thereto, said control indicator comprising a visually distinct, luminescent smoking control alert band selectively displaceable on the article relative to the markings.

(c) said control indicia and said annular control indicator cooperating to provide a smoker with heightened awareness of his smoking habit, whereby the smoker is enabled to affirmatively, selectively and voluntarily control said habit.

4. For use with a generally cylindrical smoking article having an end to be lit and an opposite end to be inserted into the mouth when the article is smoked, positive control means for selecting the extent of consumption of said smoking article, to assist a smoker in curtailing or terminating his smoking habit, said means comprising:

(a) control indicia disposed on the smoking article and extending from the end of the article to be lit toward the opposite end of the article, said control indicia comprising a plurality of spaced external markings extending axially along the article, and (b) an annular control indicator mounted telescopically on the smoking article and slidable axially relative thereto, said control indicator comprising a visually distinct vernier having at least one luminescent marking, said vernier being selectively displaceable on the article relative to the control indicia markings, (c) said control indicia and said annular control indicator cooperating to provide a smoker with heightened awareness of his smoking habit, whereby the smoker is enabled to affirmatively, selectively and voluntarily control said habit.

* * * * *